US008832909B2

(12) United States Patent
Takani

(10) Patent No.: US 8,832,909 B2
(45) Date of Patent: Sep. 16, 2014

(54) SLIDE FASTENER

(75) Inventor: Go Takani, Toyama-ken (JP)

(73) Assignee: YKK Corporation (JP)

( * ) Notice: Subject to any disclaimer, the term of this patent is extended or adjusted under 35 U.S.C. 154(b) by 100 days.

(21) Appl. No.: 13/498,962

(22) PCT Filed: Aug. 31, 2010

(86) PCT No.: PCT/JP2010/064831

§ 371 (c)(1),
(2), (4) Date: Mar. 29, 2012

(87) PCT Pub. No.: WO2011/040167

PCT Pub. Date: Apr. 7, 2011

(65) Prior Publication Data

US 2012/0180272 A1 Jul. 19, 2012

(30) Foreign Application Priority Data

Sep. 30, 2009 (WO) ..... PCT/JP2009/067082

(51) Int. Cl.
*A44B 19/06* (2006.01)

(52) U.S. Cl.
USPC ..... 24/410; 24/41

(58) Field of Classification Search
None
See application file for complete search history.

(56) References Cited

U.S. PATENT DOCUMENTS

| | | | | |
|---|---|---|---|---|
| 2,867,879 | A | 1/1959 | Urban et al. | |
| 4,142,275 | A * | 3/1979 | Krauer | 24/426 |
| 4,521,942 | A | 6/1985 | Oda | |
| 5,297,319 | A | 3/1994 | Akashi et al. | |
| 5,511,292 | A | 4/1996 | Covi et al. | |
| 6,092,267 | A * | 7/2000 | Covi et al. | 24/410 |
| 2002/0092139 | A1 | 7/2002 | Horikawa | |
| 2004/0055119 | A1 | 3/2004 | Keyaki et al. | |

FOREIGN PATENT DOCUMENTS

| | | |
|---|---|---|
| CA | 1193833 A | 9/1985 |
| CN | 1493234 A | 5/2004 |
| EP | 88355 A2 | 9/1983 |
| EP | 1400184 A2 | 3/2004 |

(Continued)

OTHER PUBLICATIONS

International Search Report and Written Opinion, PCT International Application No. PCT/JP2010/064831, mailed Nov. 30, 2010.

(Continued)

*Primary Examiner* — Jack W. Lavinder
(74) *Attorney, Agent, or Firm* — Kilpatrick Townsend & Stockton LLP

(57) ABSTRACT

A slide fastener for preventing core strings from being caught in a gap between upper and lower flanges, securing the flexibility of the slide fastener when engaged, and improving the designability of the slide fastener. The gap dimension between the upper and lower flanges of a slider in the up-down direction is smaller than the core string dimension in the front-rear direction when the core strings are pressed with the pressure of 5 kgf. Fastener elements are independently disposed in the up-down direction of a tape member when engaged. The fastener element has a design portion disposed at a front side of the tape member, and an engaging portion disposed at a rear side of the tape member so as to engage with adjacent fastener element, and the design portion is disposed distant from the adjacent design portion when engaged and having a hemispherical shape with a curved shape.

13 Claims, 14 Drawing Sheets

(56) References Cited

FOREIGN PATENT DOCUMENTS

| | | | |
|---|---|---|---|
| GB | 2116628 | A | 9/1983 |
| JP | 49-1340 | | 1/1974 |
| JP | 52-10402 | U | 1/1977 |
| JP | 10402 | | 1/1977 |
| JP | 134917/1983 | | 9/1983 |
| JP | 39011/1989 | | 3/1989 |
| JP | 11-511683 | | 10/1999 |
| JP | 2004-105570 | | 4/2004 |
| KR | 20-1984-002710 | Y | 12/1984 |
| KR | 10-2004-0025822 | A | 3/2004 |

OTHER PUBLICATIONS

European Search Report, European Patent Application No. 13195442.2, mailed Mar. 11, 2014.

Office Action, Japanese Patent Application No. 2011-534006, mailed Feb. 5, 2013.

* cited by examiner

SLIDE FASTENER

This application is a national stage application of PCT/JP2010/064831 which claims priority to PCT Application No. PCT/JP2009/067082, both of which are incorporated herein by reference.

TECHNICAL FIELD

The present invention relates to a slide fastener.

BACKGROUND ART

A slide fastener of the related art is known to include a pair of left and right tape members, a pair of fastener element rows attached to core strings which are provided along opposite tape side edges of the left and right tape members, and a slider that engages and disengages the pair of fastener element rows.

Conventionally, there is disclosed a slide fastener in which the front surface side shape of a fastener element is formed like a shape such as a button, a hook, etc., for providing a decorative function (see e.g. Patent Documents 1 to 3). In the slide fastener described in Patent Document 1, the front part and the rear part of a fastener element are formed in the same shape of substantially a mushroom, and an imitation jewel is disposed on the front side of the fastener element to provide a decorative feature. In the slide fastener described in Patent Document 2, a fastener element has a substantially rectangular front part and a rear part with a tooth part and recess parts that mesh with each other, and the front part is provided with the decorative feature. In the slide fastener described in Patent Document 3, an upper part of a rectangular element body is formed with a spherical-shaped segment and an lower part of the element body is formed with a hemispherical recess so that the spherical-shaped segment of adjacent element can engage with the hemispherical recess, and an imitation jewel or the like is arranged on the front side of the element body to provide the decorative feature. For improvement of the designability, the side fasteners described in Patent Documents 1 to 3 are configured such that the elements are attached to the fastener stringer such that the element rows are arranged in a linear fashion when the elements are engaged.

PRIOR ART DOCUMENT

Patent Document

Patent Document 1: U.S. Pat. No. 5,511,292
Patent Document 2: Japanese Patent Application Publication No. 49-1340
Patent Document 3: U.S. Pat. No. 2,867,879

SUMMARY OF INVENTION

Problems to be Solved by Invention

In the slide fasteners described in Patent Documents 1 to 3, however, since the elements are attached to each fastener stringer in a state where gaps between adjacent elements are broaden in order to arrange the element rows in a linear fashion, when the tape members are pulled out in the width direction of the slider, core strings exposed between the elements may come into contact with upper and lower flanges of the slider, thereby being pressed. Then, the core strings may slide out through the gap between the upper and lower flanges, or may be caught in the gap between the upper and lower flanges.

The present invention has been made keeping in mind the above problems, and an object of the present invention is to provide a slide fastener capable of preventing the core strings from sliding out through the gap between the upper and lower flanges, or from being caught in the gap between the upper and lower flanges, securing the flexibility of the slide fastener when engaged, and improving the designability.

Means for Solving Problems

The above object of the present invention can be achieved by the following configurations.

(1) A slide fastener including a pair of tape members disposed in parallel in a left-right direction, a pair of fastener element rows attached to core strings which are arranged along opposite tape-side edges of the tape members, and a slider into which the pair of fastener element rows are inserted, the slider that engages and disengages the pair of fastener element rows, wherein each of the fastener element rows is composed of a plurality of fastener elements, wherein each of the fastener elements includes a design portion disposed at a front side of the tape member, and an engaging portion disposed at a rear side of the tape member so as to engage with adjacent fastener element, wherein the slider includes: an upper blade and a lower blade, which are disposed in parallel and distant from each other in an up-down direction; upper flanges provided along left and right side edges of the upper blade, respectively; lower flanges provided along left and right side edges of the lower blade, respectively; a guide post connecting the upper and lower blades; and a substantially Y-shaped element guide passage surrounded by the upper blade, the lower blade, the upper flanges and the lower flanges, and having shoulder mouths and a rear mouth, wherein plate thicknesses of the upper and lower flanges are smaller than a distance between adjacent fastener elements, and wherein a dimension of a gap between the upper and lower flanges in the up-down direction is smaller than a dimension of the core strings in an front-rear direction when the core strings are pressed with a pressure of 5 kgf.

(2) The slide fastener according to (1), a distance between the plurality of fastener elements is equal to or greater than a length of the design portion of each of the fastener elements in the up-down direction, and the fastener elements are independently disposed in the up-down direction of the tape members when engaged.

(3) The slide fastener according to (1) or (2), two or more core strings are arranged in the front-rear direction of the tape members and woven or knitted to the tape member.

(4) The slide fastener according to any one of (1) to (3), the upper and lower flanges are provided at front portions thereof with parallel portions that respectively formed in parallel with a longitudinal direction of the tape members, and the parallel portions extend forward from a point at one-half length of the guide post in a back-forth direction thereof.

(5) The slide fastener according to any one of (1) to (4), rear end portions of the fastener elements are formed at a side of the tape members relative to the core strings.

(6) The slide fastener according to any one of (1) to (5), the design portion is disposed distant from an adjacent design portion when engaged, and a tape-receiving groove for receiving the tape-side edge of the counterpart tape member when engaged is provided at a leading end portion of each of the fastener elements and between the design portion and the engaging portion.

(7) The slide fastener according to (6), the engaging portion includes a base portion attached to the tape member, an engaging head portion extending from the base portion towards the counterpart tape member and having the tape-receiving groove therein, and a neck portion provided between the base portion and the engaging head portion, wherein the engaging head portion has engaging portions protruding in the up-down direction, wherein the engaging portions include first engaging parts protruding from upper and lower ends of the design portion in the up-down direction, respectively, and second engaging parts continued from the first engaging parts and formed concavely from the upper and lower ends of the design portion, and wherein the first engaging parts are formed so as to extend toward a side of the design portion relative to a central line of the tape members in the front-rear direction thereof.

(8) The slide fastener according to (7), the first engaging parts are formed inside relative to an end portion of the tape-receiving groove at a side of the design portion in the front-rear direction thereof.

(9) The slide fastener according to any one of (6) to (8), the design portion has a hemispherical shape with a curved shape.

(10) The slide fastener according to (7), the a length of each of the first engaging parts in the up-down direction is set to be shorter than a length of a gap between the design portions adjacent to each other in the up-down direction when the pair of fastener element rows are engaged with each other in a linear fashion.

(11) The slide fastener according to (7), each of the second engaging parts is formed from the vicinity of the central line of the tape members in the front-rear direction over an end portion of the engaging portion at a rear side.

Advantageous Effects of Invention

According to the slide fastener of the present invention, the dimension of the gap between the upper and lower flanges in the up-down direction is smaller than a dimension of the core strings in the front-rear direction when the core strings are pressed with the pressure of 5 kgf, so that the core strings are prevented from sliding out through the gap between the upper and lower flanges and from being caught in the gap.

MODE TO CARRY OUT INVENTION

Figure 1:
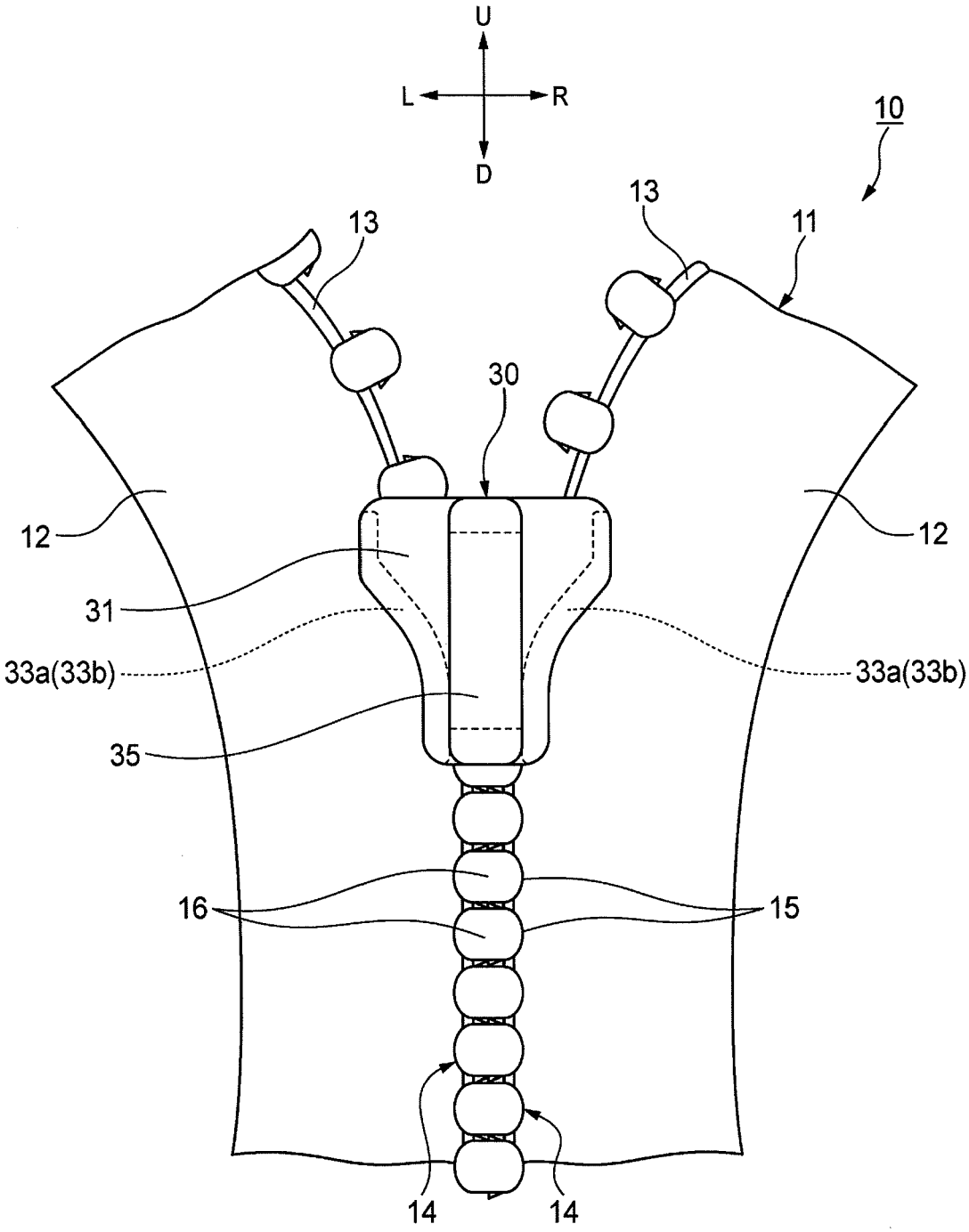
FIG. 1 is a front surface view of a slide fastener according to the present invention when viewed from the front surface side.

Hereinafter, a slide fastener according to an embodiment of the present invention will be described in detail with reference to the accompanying drawings. In the following description with respect to the tape members and the fastener elements, the front side means a near side relative to the plane of paper of FIG. 1, the rear side means a far side relative to the plane of paper of FIG. 1, the upper side means the upper side relative to the plane of paper of FIG. 1, the lower side means the lower side relative to the plane of paper of FIG. 1, the left side means the left side relative to the plane of paper of FIG. 1, and the right side means the right side relative to the plane of paper of FIG. 1. The front side, the rear side, the upper side, the lower side, the left side and the right side are denoted by Hs, Bs, U, D, L and R, respectively in the drawings. In addition, with respect to a slider, the upper side means the near side relative to the plane of paper of FIG. 1, the lower side means the far side relative to the plane of paper of FIG. 1, the front side means the upper side relative to the plane of paper of FIG. 1, the rear side means the lower side relative to the plane of paper of FIG. 1, the left side means the left side relative to the plane of paper of FIG. 1, and the right side means the right side relative to the plane of paper of FIG. 1. Further, the left-right direction of the tape members and slider is also referred to as the width direction thereof. In addition, the up-down direction of the tape members is also referred to as the longitudinal direction thereof.

A slide fastener 10 of this embodiment comprises a fastener stringer 11 and a slider 30, as shown in FIG. 1. The slide fastener also comprises well-known stops or a separable end stop, which are not shown, at upper and lower end portions of tape members, if needed. The fastener stringer 11 comprises a pair of left and right tape members 12 that are disposed in parallel in the left-right direction, and a pair of left and right fastener element rows 14 that are attached to opposite tape-side edges 13 of the left and right tape members 12. By moving the slider 30 in the longitudinal direction of the fastener stringer 11, the left and right fastener element rows are engaged with and disengaged from each other.

Each of fastener element rows 14 is composed of a plurality of fastener elements 15. The fastener elements 15 are injection-molded to the tape-side edges 13 of the tape members 12 with synthetic resin such as e.g. polyamide, polyacetal, polypropylene, polybutyleneterephthalate, or the like.

Figure 2:
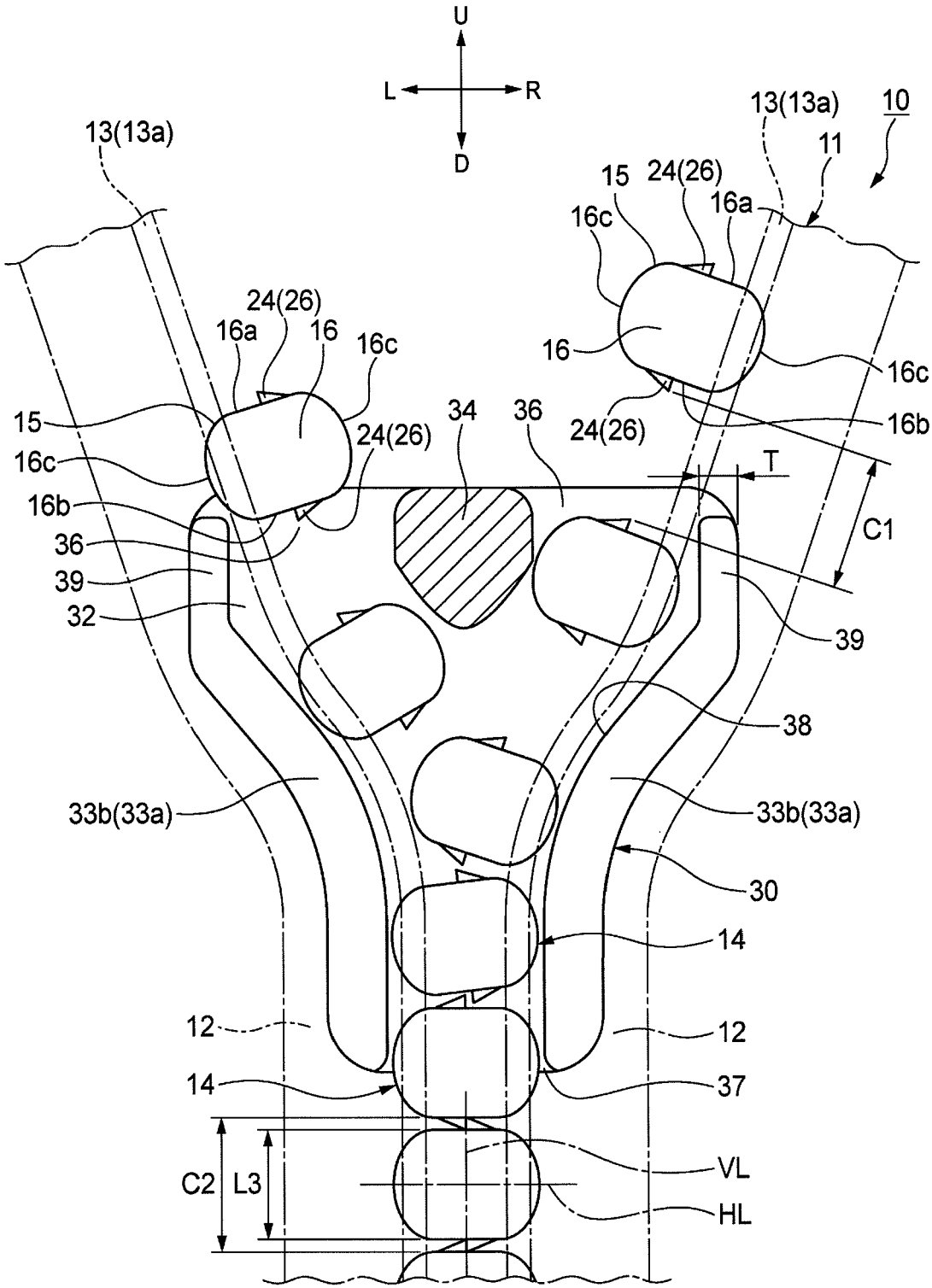
FIG. 2 is an enlarged cross-sectional view of the surrounding of a slider of the slide fastener shown in FIG. 1.
Figure 8:
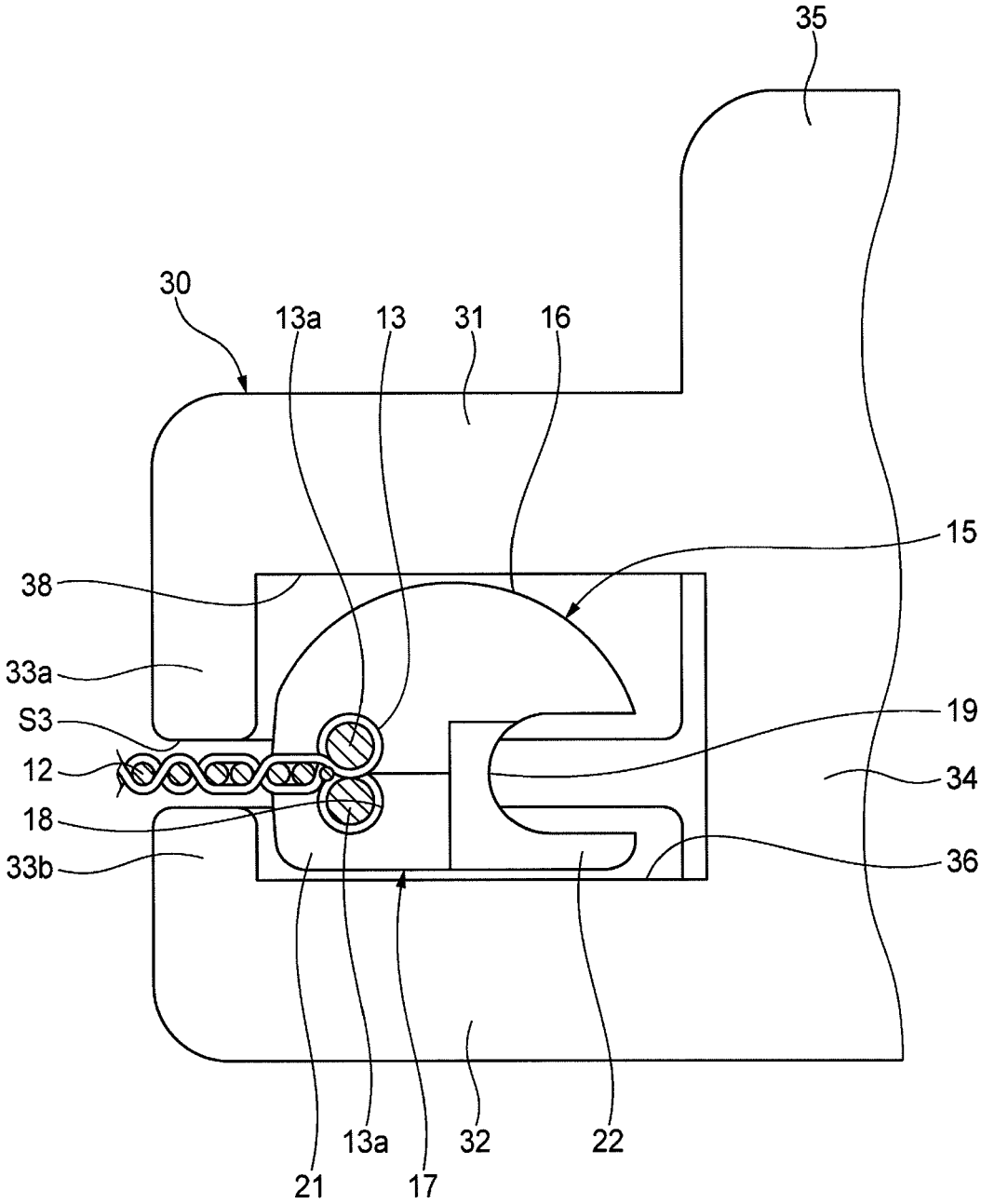
FIG. 8 is a view of the slider in a state where the fastener element is inserted into an element guide passage when viewed from a side of a shoulder mouth.

As shown in FIG. 1, FIG. 2, and FIG. 8, the slider 30 comprises an upper blade 31 and a lower blade 32 which are disposed in parallel and distant from each other in an up-down direction, a pair of left and right upper flanges 33*a* which are provided along left and right side edges of the upper blade 31 and directed to the lower blade 32, a pair of left and right lower flanges 33*b* which are provided along left and right side edges of the lower blade 32 and directed to the upper blade 31, a guide post 34 which connects the upper and lower blades 31 and 32 at a front end portions thereof, a pull-tab attaching portion 35 which is provided on the upper surface of the upper blade 31, and a pull-tab, which is not shown, rotatably attached to the pull-tab attaching portion 35. Consequently, the slider 30 is provided at the front portion thereof with left and right shoulder mouths 36 which are separated by the guide post 34, and at the rear portion thereof a rear mouth 37. A substantially Y-shaped element guide passage 38 which communicates the left and right shoulder mouths 36 with the rear mouth 37 is provided between the upper blade 31 and lower blade 32. The element guide passage 38 forms a channel through which the left and right fastener element rows 14 are inserted.

As shown in FIG. 2, plate thicknesses T of the upper and lower flanges 33*a* and 33*b* are set to be smaller than a distance C1 between the adjacent fastener elements 15.

As shown in FIG. 2 to FIG. 6, each of the fastener elements 15 has a design portion 16 which is disposed at a front side of the tape member 12, and an engaging portion 17 which is disposed at a rear side of the tape member 12 so as to engage with adjacent fastener element 15. A tape-fitting groove 18 through which the tape-side edge 13 is fixedly inserted, is formed along the up-down direction at one side portion between the design portion 16 and the engaging portion 17 (an intermediate portion in the front-rear direction), and a substantially U-shaped tape-receiving groove 19 which receives the side edge 13 of the counterpart tape member 12 is formed along the up-down direction at the other side portion, i.e. at the side portion at an engaging head portion 22 side. Further, the design portion 16 is disposed distant from adjacent design portion 16 when being engaged.

The design portion 16, as shown in FIG. 2 to FIG. 7, in a front view, is formed in a substantially oval shape which is longitudinally symmetric with respect to a central line HL of the design portion 16 in the left-right direction and is laterally symmetric with respect to a central line VL of the design portion 16 in the up-down direction, and when viewed in the up-down direction and the left-right direction, is formed in a substantially hemispherical shape with a curved shape as a whole. As shown in FIG. 2, a distance C2 between the design portions 16 of the adjacent fastener elements 15 is set to be equal to or larger than a length L3 of the design portion 16 in the up-down direction. Thus, when the left and right fastener element rows 14 are engaged with each other, the design portions 16 of the plurality of fastener elements 15 are independently disposed in the up-down direction of the tape member 12. In addition, the design portion 16 may have any shape such as a circle shape or an oval shape, so long as the shape has an excellent designability when viewed from the front side, has no corners, and is able to secure the flexibility of the slide fastener 10. Further, both left and right sides 16*c* and 16*c* of the design portion 16 are defined by curved surfaces that are gradually curved in the up-down direction from the central line HL in the left-right direction.

Figure 3:
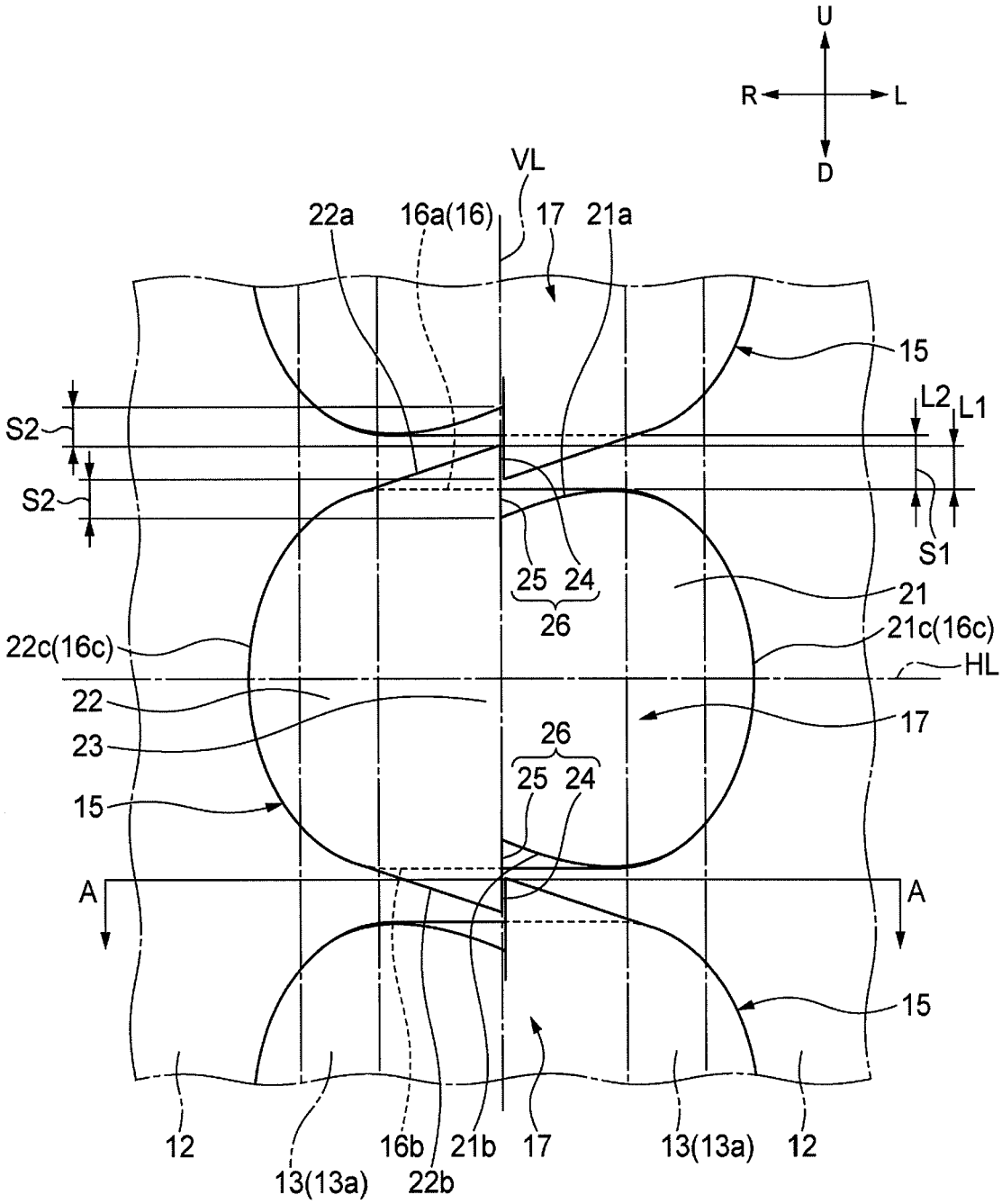
FIG. 3 is an enlarged rear surface view of a fastener element when viewed from the rear surface side.
Figure 5:
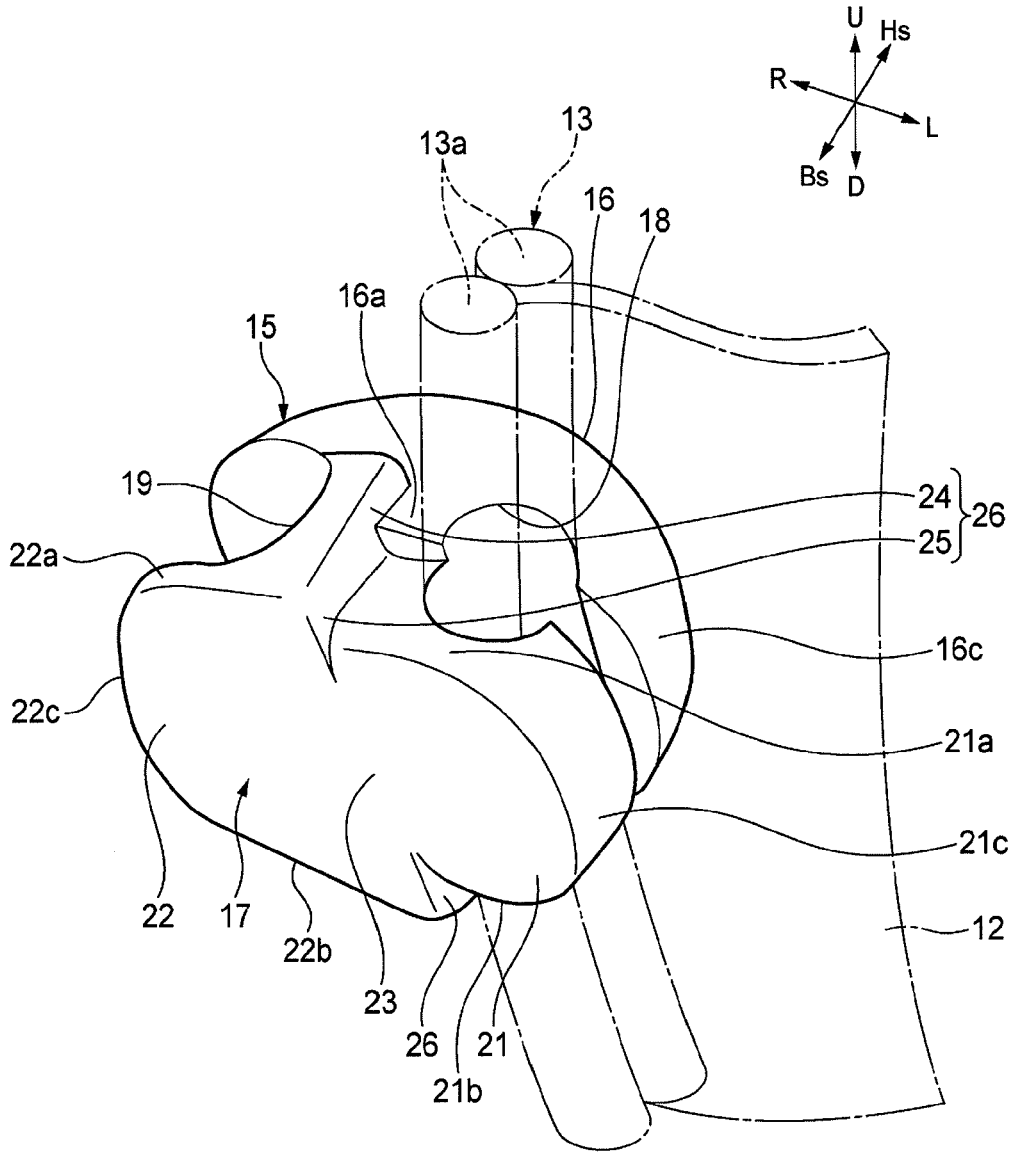
FIG. 5 is a perspective view of the fastener element when viewed from the rear surface side.

The engaging portion 17, as shown in FIG. 3 and FIG. 5, comprises a base portion 21 being attached to the tape member 12, an engaging head portion 22 extending from the base portion 21 towards the counterpart tape member 12 and being formed with the tape-receiving groove 19, and a neck portion 23 being provided between the base portion 21 and the engaging head portion 22 such that the width thereof is shorter than that of the engaging head portion 22 in the up-down direction. Both left and right sides 21*c* and 22*c* of the engaging portion 17 are defined by curved surfaces that are gradually curved in the up-down direction from the central line HL in the left-right direction.

In the engaging portion 17, an engaging portion 26 which is comprised of first engaging parts 24 protruding from upper end 16*a* and lower end 16*b* of the design portion 16 in the up-down direction, respectively and second engaging parts 25 continued from the first engaging parts 24 and formed concavely from the upper and lower ends 16*a* and 16*b* of the design portion 16 is formed projectingly in the up-down direction. In the present embodiment, the length L1 of the first engaging part 24 in the up-down direction is set to be shorter than the length L2 of a gap S1 between the design portions 16 adjacent to each other in the up-down direction when the left and right fastener element rows 14 are engaged with each other in a linear fashion. In other words, the length L1 of the first engaging part 24 in the up-down direction is set so as not to come in contact with the upper and lower ends 16*a* and 16*b* of the design portions 16 of the adjacent fastener elements 15. In addition, gaps S2 are created between the upper and lower ends of the first engaging parts 24 and standing portions of the second engaging parts 25 of the adjacent fastener elements 15 (which are boundaries between the second engaging parts 25 and the neck portions 23).

Figure 6:
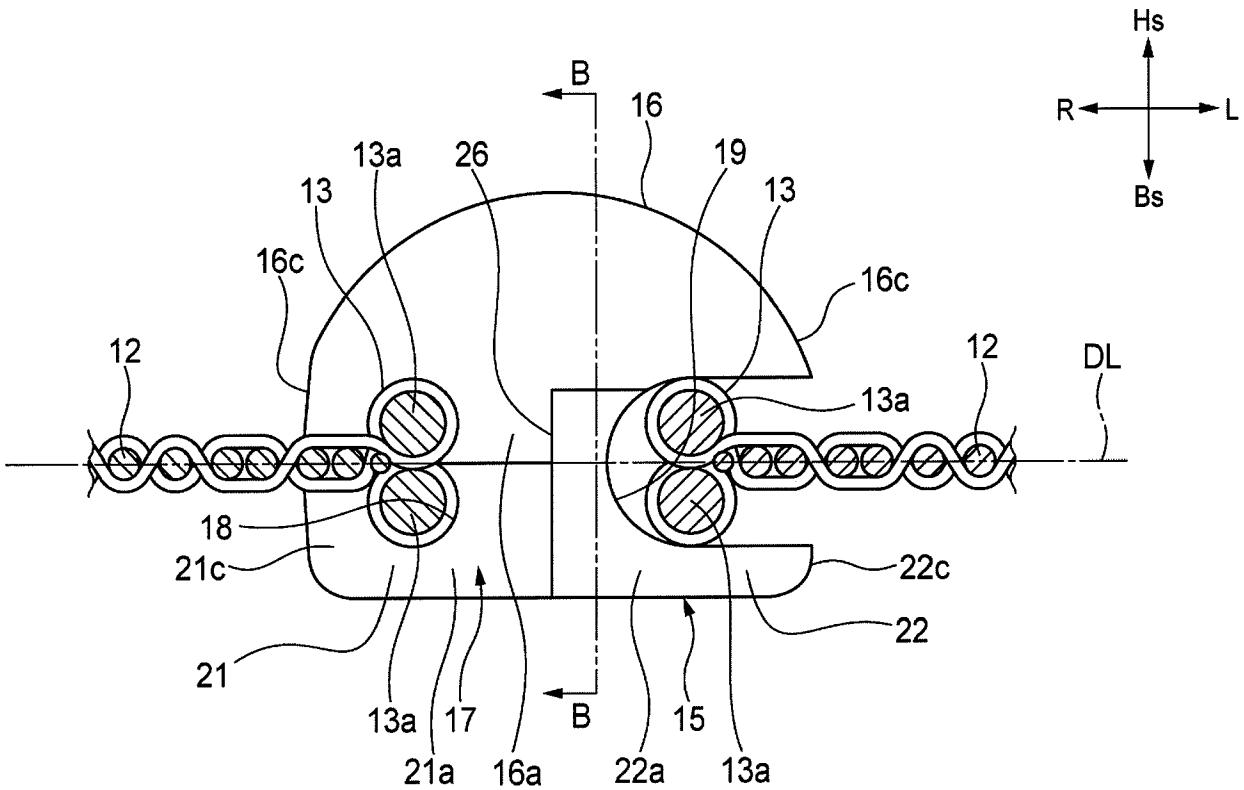
FIG. 6 is a cross-sectional view taken along line A-A of FIG. 3.
Figure 7:
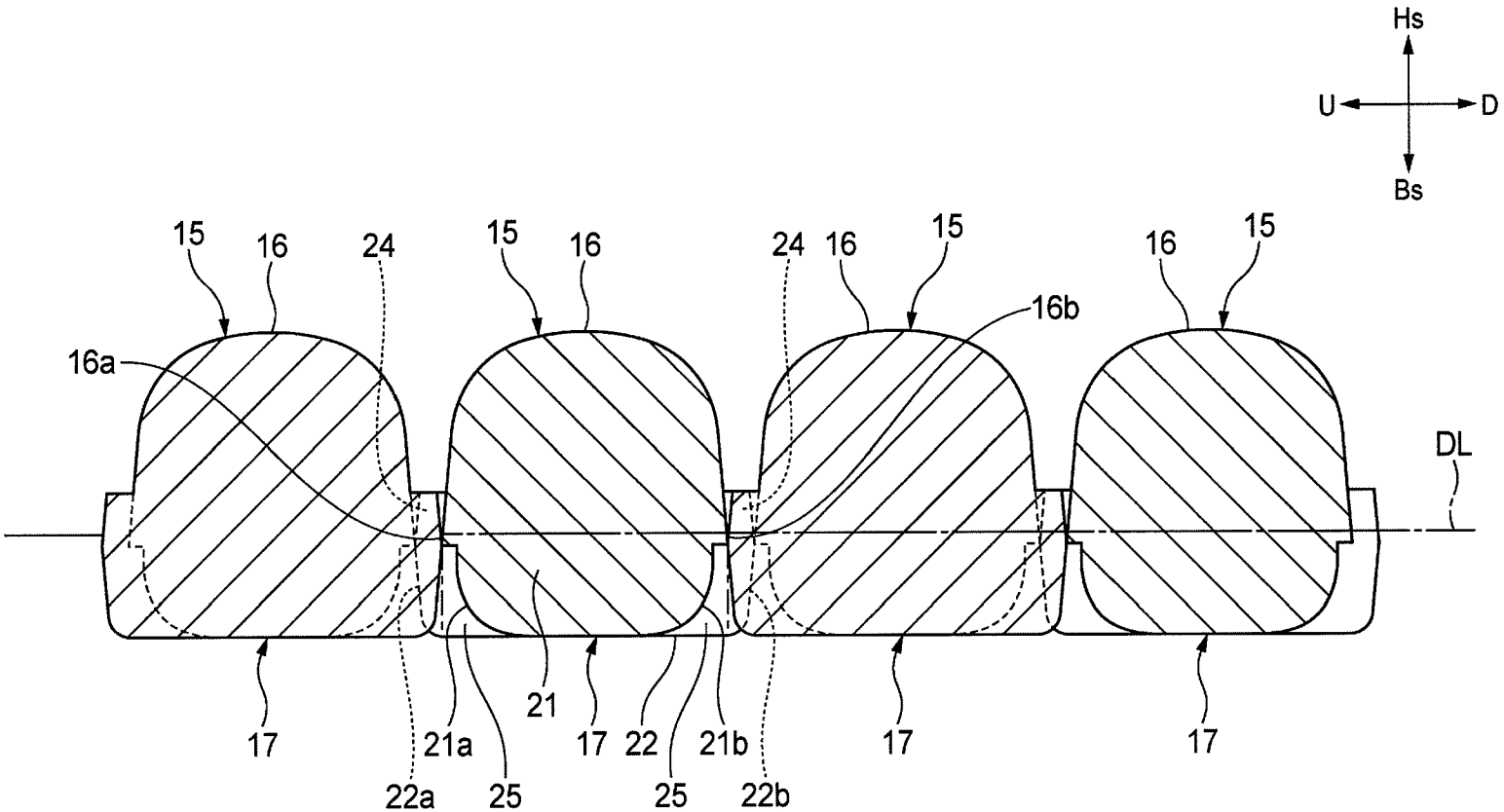
FIG. 7 is a cross-sectional view taken along line B-B of FIG. 6.

As shown in FIG. 6 and FIG. 7, the first engaging part 24 extends towards a side of the design portion 16 relative to the central line DL in the front-rear direction of the tape member 12, and is formed at a side of the central line DL in the front-rear direction relative to the end surface of the tape-receiving groove 19 at the side of the design portion 16. In addition, the second engaging part 25 is formed so as to extend from the vicinity of the central line DL in the front-rear direction of the tape member 12 over the end portion of the engaging portion 17 at a rear side. Moreover, the second engaging parts 25 formed in the fastener element 15 in the up-down direction are formed from the front direction toward the rear direction of the engaging part 17 so as to approach each other.

As shown in FIG. 3, FIG. 5, and FIG. 6, the upper and lower surfaces 22*a* and 22*b* of the engaging head portion 22 are defined by inclined surfaces which gradually decrease in width from the neck portion 23 to outer end portions 22*c* of the engaging head portion 22 in the left-right direction. In addition, the upper and lower surfaces 21*a* and 21*b* of the base portion 21 are defined by inclined surfaces which gradually increases from the neck portion 23 to a widthwise end 21*c* of the base portion 21. Further, the front and rear surfaces 21*a* and 21*b* of the base portion 21 each are defined by a curved surface which gradually increase in width from the outer end portion 21*c* toward the neck portion 23. That is to say, the upper and lower surfaces 21*a* and 21*b* form substantially ark-like curved surfaces when viewed from the rear side.

Figure 4:
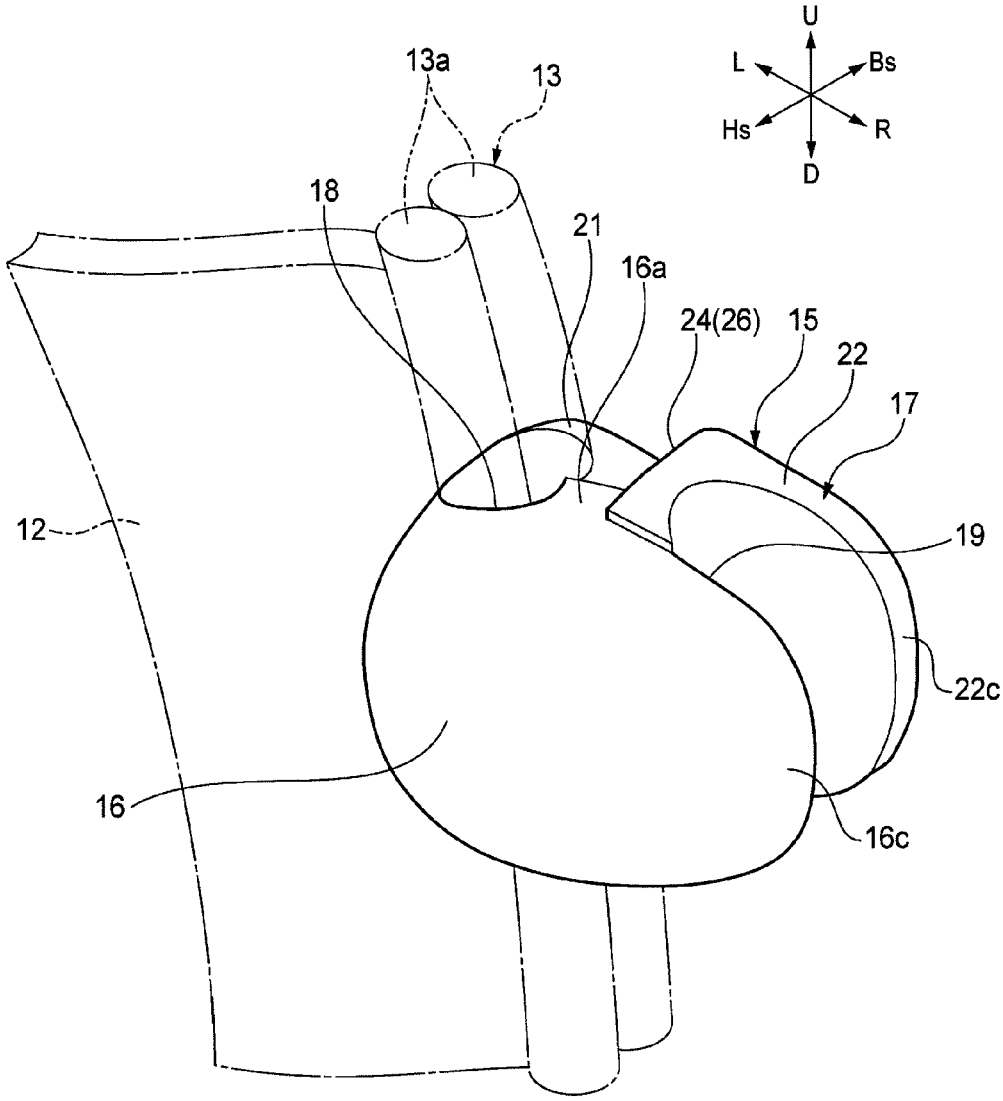
FIG. 4 is a perspective view of the fastener element when viewed from the front surface side.
Figure 9:
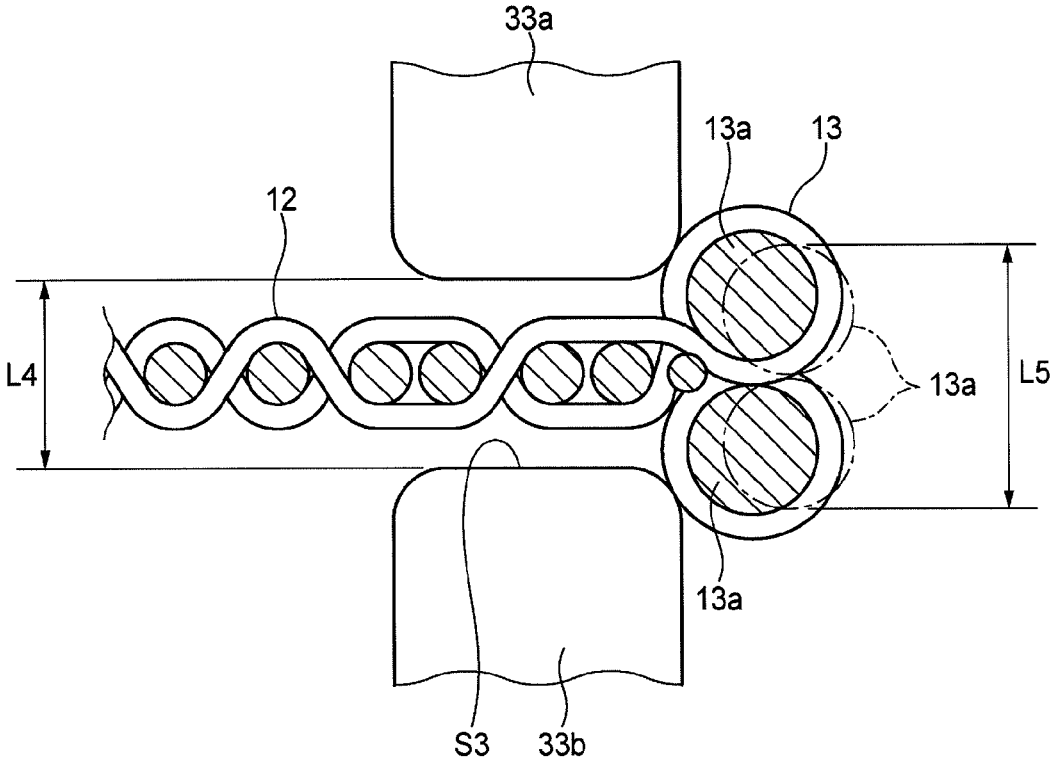
FIG. 9 is an enlarged view for explaining a state where the tape members are pulled and two core strings come into contact with the upper and lower flanges of the slider.

As shown in FIG. 4 to FIG. 6, two or more core strings 13*a* are woven or knitted to each tape-side edge 13 along the front-rear direction of the tape member 12. Thus, as shown in FIG. 9, even if the tape member 12 is pulled out in the width direction of the slider 30, since the core strings 13 are individually fixed to both sides of the tape member 12 in the front-rear direction relative to the central line DL in the front-rear direction as a boundary, each core string 13*a* is applied with force being exerted from only one direction. That is, the core string 13*a* at the front side is substantially applied with force being exerted from only the upper flange 33*a*, while the core string 13*a* at the rear side is substantially applied with force being exerted from only the lower flange 33*b*, thereby preventing the core strings 13*a* from being extremely pressed (see dashed dotted line in FIG. 9).

As shown in FIG. 8 and FIG. 9, the dimension L4 of a gap S3 between the upper and lower flanges 33*a* and 33*b* in the up-down direction is set to be smaller than the dimension L5 of the two core strings 13*a* in the front-rear direction when the tape member 12 is pulled out in the width direction (transverse pulling force). Thus, the two core strings 13*a* cannot slide out through the gap S3 between the upper and lower flanges 33*a* and 33*b* and thus the two core strings 13*a* cannot be caught in the gap S3.

Figure 10:
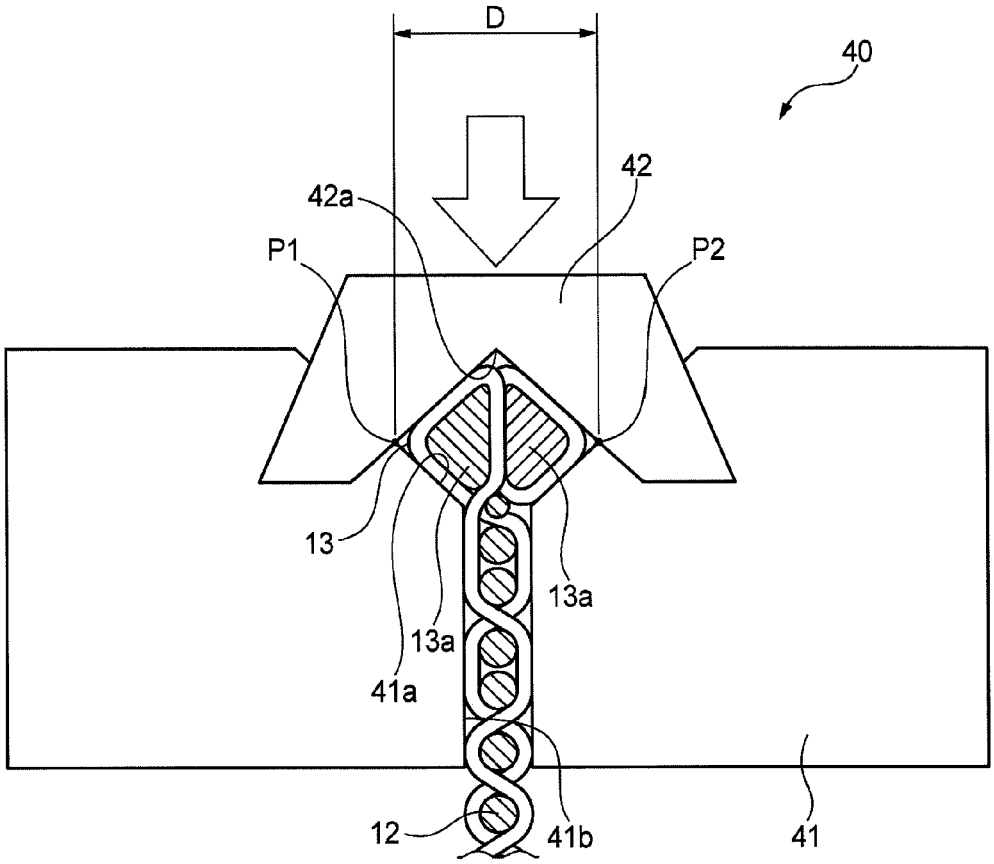
FIG. 10 is a front view of a measuring device.

The dimension L5 of the two core string s 13*a* in the front-rear direction when the tape member 12 is pulled out in the width direction can be measured by a measuring device 40 shown in FIG. 10. The measuring device 40 comprises a lower die 41 formed on the upper surface thereof with a substantially V-shaped core string-receiving groove 41*a* for receiving the two core strings 13*a* (the tape-side edges 13) of the tape member 12, and an upper die 42 provided so as to move down towards the lower die 41 and formed on the lower surface thereof with a substantially inverted V-shaped core string-pressing groove 42*a* for pressing the two core strings 13*a* which are received in the core string-receiving groove 41*a*. An angle defined by the core string-receiving groove 41*a* and core-string-pressing groove 42*a* is preset at a right angle. In addition, the lower die 41 is formed with a tape-receiving portion 41*b* that continuously extends from the bottom of the core string-receiving groove 41*a* so as to receive the tape member 12. The measurement of the measuring device 40 is carried out by pressing the two core strings 13*a* with the upper die 42 against the lower die 41, so as to measure the compressed dimension (PM (Pressure Measurement) value) D between intersection points P1 and P2 of the core string-receiving groove 41*a* and the core string-pressing groove 42*a* when a certain amount of pressure is applied to the upper die 42.

Here, the pressure applied to the two core strings 13*a* corresponds to the dimension L5 in the front-rear direction, and it is preset to 5 kgf, taking account of a lateral pulling force that is to be applied to the tape member 12 that in use, is attached to a target body such as cloths, bags, etc. That is, in the present invention, the dimension L4 of the gap S3 between the upper and lower flanges 33*a* and 33*b* in the up-down direction is set smaller than the dimension L5 of the core strings 13*a* in the front-rear direction when the core strings are pressed with the pressure of 5 kgf, so that, even though the tape member 12 is used while being attached to the target body, the core string 13*a* is prevented from being caught in the gap S3 between the upper and lower flanges 33*a* and 33*b* due to the lateral puling force.

As shown in FIG. 2, the upper and lower flanges 33*a* and 33*b* are formed at front portions thereof with parallel portions 39 that respectively extend in parallel with the longitudinal direction of the tape member 12. The parallel portions 39 extend forwards from a point at one-half length of the guide post 34 in the back-forth direction thereof. The posture of the fastener elements 15 entering the shoulder mouths 36 of the slider 30 can be aligned in front of an engaging position, and the deformation such as torsion deformation of the tape member 12 can be prevented, so that it becomes difficult for the core strings 13*a* to be caught in the gap S3 between the upper and lower flanges 33*a* and 33*b*.

As shown in FIG. 3 and FIG. 6, the rear end portion (end portion at a side of the outer end portion 21*c*) of the design portion 16 and engaging portion 17 of each fastener element 15 is are formed at a side of the tape member 12 relative to the core string 13*a* (i.e. at a side of the side edge which is opposite to the side edge to which the core strings 13*a* are fixed). Thus, the fastener elements 15 move in the slider 30 while the rear end portion of the engaging portion 17 comes into contact with the upper and lower flanges 33*a* and 33*b*, so that the core strings 13*a* become difficult to come into contact with the upper and lower flanges 33*a* and 33*b* of the slider 30, thereby preventing the core strings 13*a* from being damaged. Since the rear end portion of the engaging portion 17 which is formed at a side of the tape member 12 relative to the core strings 13*a* has a curved shape, the fastener element is smoothly guided into the slider 30.

In the slider fastener 10 constructed as such, since the design portion 16 is formed in a substantially oval shape that is longitudinally symmetric with respect to the central line HL in the left-right direction of the design portion 16 and is laterally symmetric with respect to the central line VL in the up-down direction, it is possible to secure the flexibility of the slider fastener and improve the designability of the slide fastener 10. In addition, since the fastener elements are not caught in the opening portions at the shoulder mouths 36 side when being inserted into the element guide passage 38 of the slider 30, it is possible to secure a sliding feature of the slider 30.

Figure 11:
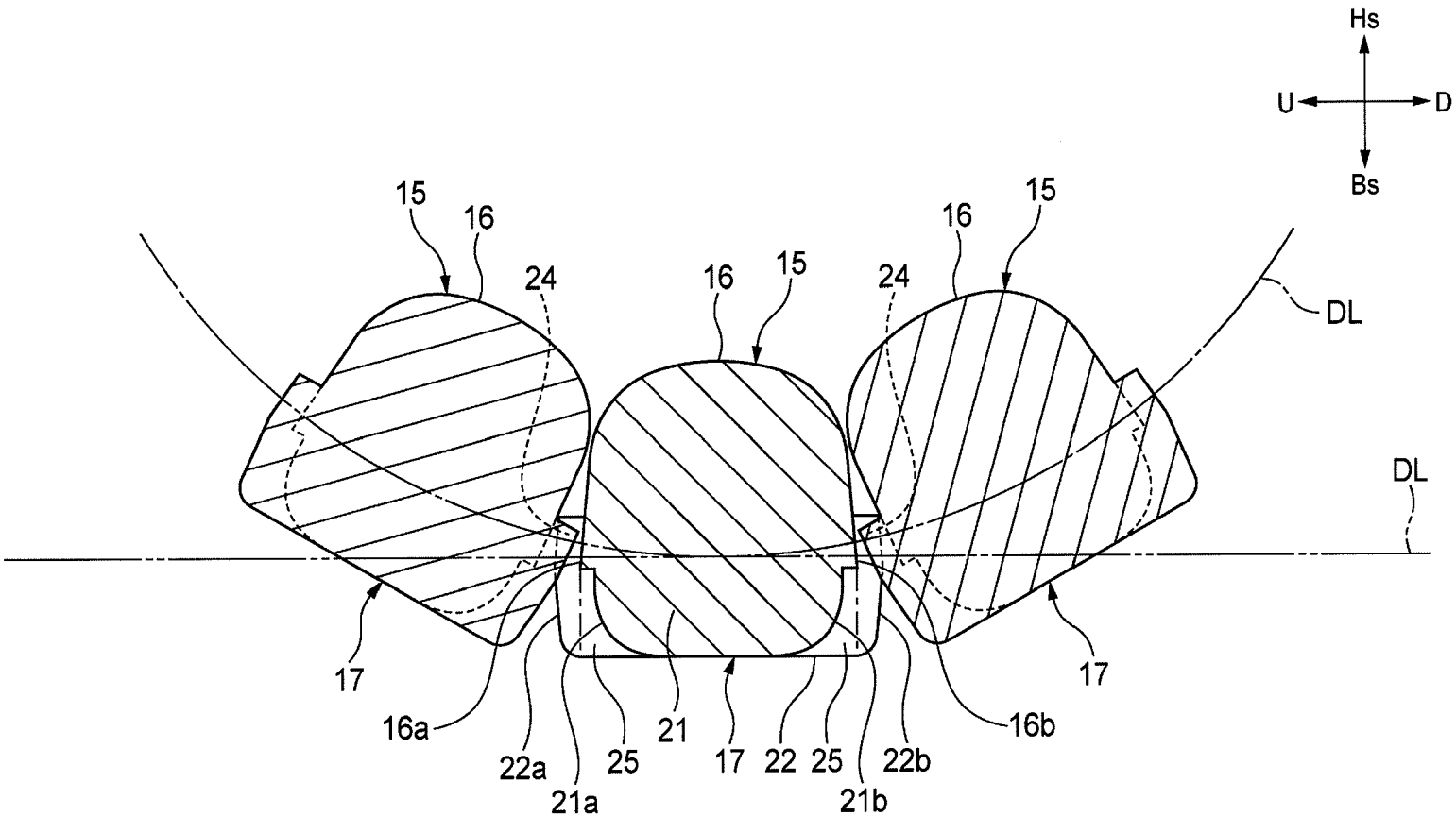
FIG. 11 is a cross-sectional view corresponding to FIG. 7, in which the slide fastener that is in the engaged state is bent projectingly rearwards.

Since the design portion 16 is formed in a substantially hemisphere shape with a curved shape as a whole when viewed in the up-down and left-right directions, even when the slide fastener 10 is bent projectingly rearwards as shown in FIG. 11, adjacent design portions 16 do not directly interfere with each other, thereby improving the flexibility of the slide fastener 10. Further, since a gap S1 is provided between the adjacent fastener elements 15, the flexibility of the slide fastener 10 can be further improved.

Even when the slide fastener 10 is bent projectingly rearwards, the first engaging parts 24 which are formed so as to extend towards the design portion 16 side relative to the central line DL in the front-rear direction of the tape member 12 are engaged with each other, thereby improving the flexibility of the slide fastener 10 while keeping the left and right fastener element rows 14 engaged. Further, even if the slide fastener is intended to be further bent projectingly rearwards from the position shown in FIG. 11, the adjacent design portions 16 will come into contact with each other at their upper and lower curved surfaces, so that further bending is prevented. Like this, since the upper and lower curved surfaces formed between the upper and lower surfaces from the front surface of the design portion 16 come into contact with each other, even if the slide fastener is bent to some more extent, it is possible to secure the flexibility of the slide fastener 10 while keeping the fastener element rows 14 engaged.

Figure 12:
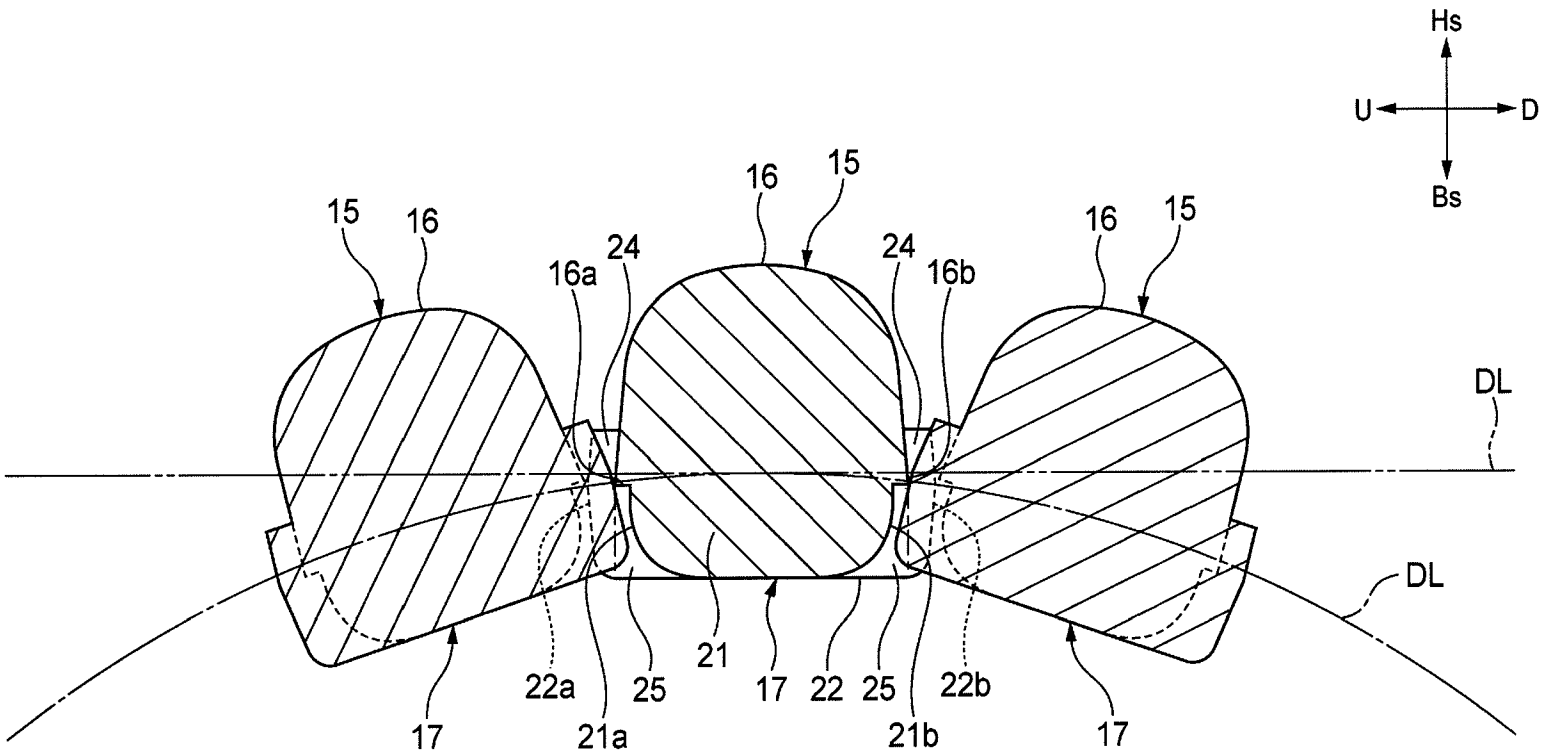
FIG. 12 is a cross-sectional view corresponding to FIG. 7, in which the slide fastener that is in the engaged state is bent projectingly frontwards.

As shown in FIG. 12, when the slide fastener 10 is bent projectingly frontwards, the gap S2 is provided so that the flexibility of the slide fastener 10 can be secured, and the second engaging parts 25, which do not contribute to the engagement when engaged in a linear pattern, become engaged with each other, increasing the engaged area of the engaging portion 26, so that the engagement between the left and right fastener element rows 14 becomes intensified.

Figure 13:
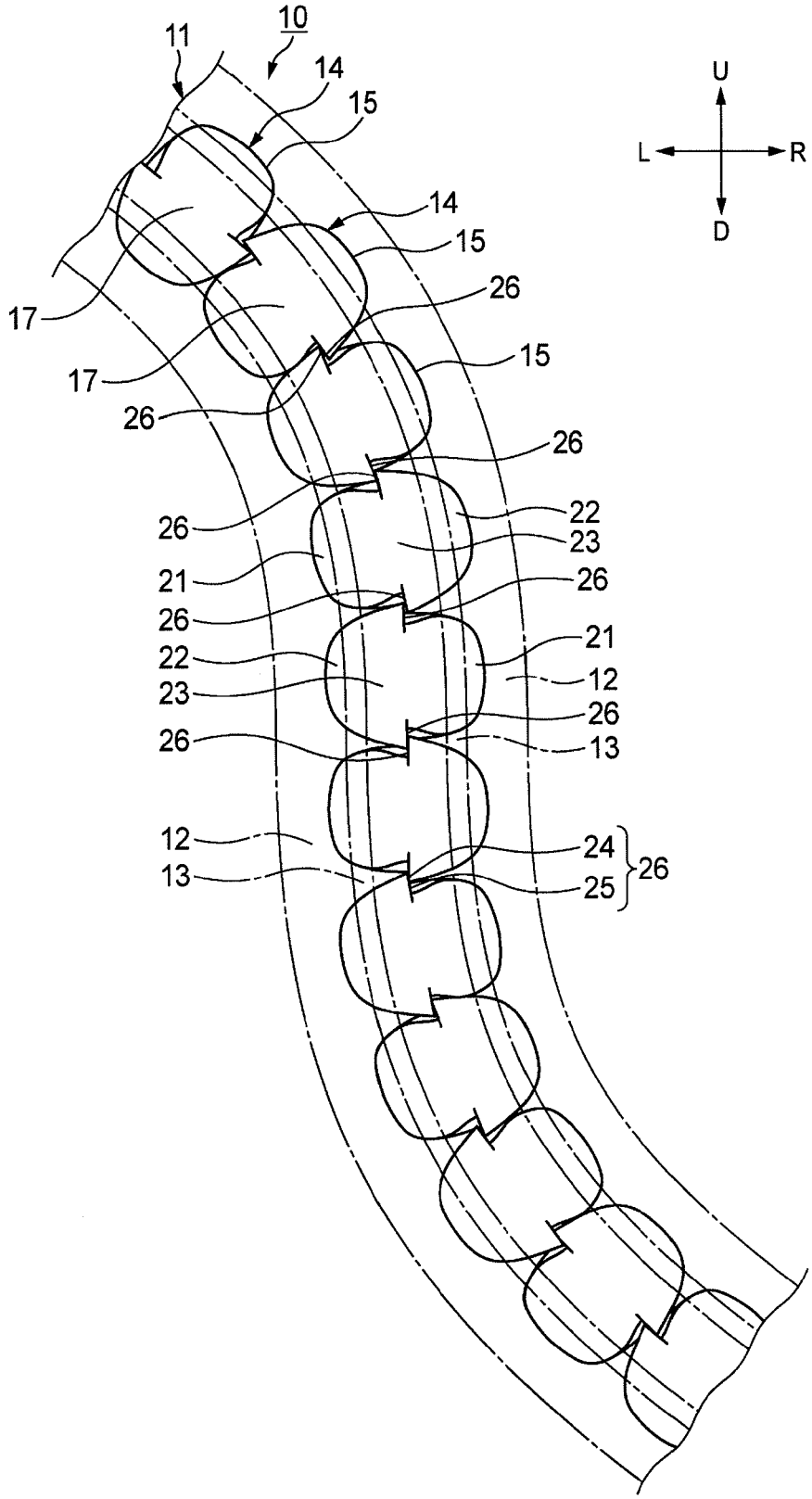
FIG. 13 is a rear surface view of the slide fastener in a state where the slide fastener that is in the engaged state is bent in the left-right direction.

The upper and lower surfaces 22*a* and 22*b* of the engaging head portion 22 are defined by the inclined surfaces which gradually decrease in width from the neck portion 23 to the outer end portions 22*c* of the engaging head portion 22 in the left-right direction, and the gaps S2 are created between the upper and lower ends of the first engaging parts 24 and the standing portions of the second engaging parts 25 of the adjacent fastener elements 15, so that even when the slide fastener 10 is bent in the left-right direction as shown in FIG. 13, adjacent engaging portions 17 do not directly interfere with each other, thereby improving the flexibility of the slide fastener 10.

As previously explained, according to the slide fastener 10 of the embodiment, the dimension L4 of the gap S3 between the upper and lower flanges 33*a* and 33*b* in the up-down direction is smaller than the dimension L5 of the two core strings 13*a* when the core strings are pressed with the pressure of 5 kgf, so that, the core strings 13*a* are prevented from sliding out through the gap S3 between the upper and lower flanges 33*a* and 33*b* and from being caught in the gap S3.

According to the slide fastener 10 of the embodiment, the distance C2 between the adjacent fastener elements 15 is equal to or larger than the length L3 of the design portion 16 in the up-down direction, and even when the slide fastener is used in which the fastener elements 15 are independently disposed in the up-down direction of the tape member 12 when the fastener elements are engaged, the core strings 13*a* are prevented from sliding out through the gap S3 between the upper and lower flanges 33*a* and 33*b* and from being caught in the gap S3.

According to the slide fastener 10 of the embodiment, since the core strings 13*a* are respectively fixed in a state where the core strings 13*a* are individually disposed at both sides of the tape member 12 in the front-rear direction, even when a strong lateral pulling force is applied to the core strings 13*a*, the core strings 13*a* are prevented from being extremely deformed. Thus, the core strings 13*a* are prevented from sliding out through the gap S3 between the upper and lower flanges 33*a* and 33*b* and being caught in the gap S3.

According to the slide fastener 10 of the embodiment, the upper and lower flanges 33*a* and 33*b* have at front portions thereof parallel portions 39 that are respectively formed in parallel with the longitudinal direction of the tape member 12. The parallel portions 39 extend forwards from a point at one-half length of the guide post 34 in the back-forth direction thereof. With these parallel portions 39, the posture of the fastener elements 15 entering into the shoulder mouths 36 of the slider 30 can be aligned in front of the engaging position, and the deformation such as torsion deformation of the tape member 12 can be prevented. Thus, it becomes difficult for the core strings 13*a* to be caught in the gap S3 between the upper and lower flanges 33*a* and 33*b*.

According to the slide fastener 10 of the embodiment, the rear end portion of the fastener element 15 is formed at a side of the tape member 12 relative to the core strings 13*a*, so that the upper and lower flanges 33*a* and 33*b* of the slider 30 are unlikely to come into contact with the core strings 13*a*, thereby preventing the core strings 13*a* from being damaged.

The fastener elements 15 are independently disposed in the up-down direction of the tape members 12 when engaged. The fastener element 15 have the design portion 16 disposed at a front side of the tape member 12, and the engaging portion 17 which is disposed at a rear side of the tape member 12 so as to engage with the adjacent fastener element 15. Since the design portion 16 is disposed distant from an adjacent design portion when engaged and the design portion 16 has a substantially hemispherical shape with a curved shape as a whole, the flexibility of the slide fastener 10 when engaged can be secured and designability of the slide fastener 10 can be improved.

According to the slide fastener 10 of the embodiment, since the design portion 16 is formed in a substantially oval shape that is longitudinally symmetric with respect to the central line HL in the left-right direction of the design portion 16 and is laterally symmetric with respect to the central line VL in the up-down direction, the design portion 16 can have a balanced shape, and thus it become possible to further improve the designability of the design portion 16.

According to the slide fastener 10 of the embodiment, since the design portion 16 is formed in a substantially hemisphere shape with a curved shape as a whole when viewed in both the up-down and left-right directions, even when the slide fastener 10 is bent projectingly rearwards, adjacent design portions 16 do not directly interfere with each other, thereby improving the flexibility of the slide fastener 10. Further, since the gap S1 is provided between the adjacent fastener elements 15, the flexibility of the slide fastener 10 can be further improved.

According to the slide fastener 10 of the embodiment, since the first engaging parts 24 are formed so as to extend towards the design portion 16 side relative to the central line DL in the front-rear direction of the tape member 12, even when the slide fastener 10 is bent projectingly rearwards, the first engaging parts 24 are not disengaged from each other, thereby improving the flexibility of the slide fastener 10 while keeping the left and right fastener element rows 14 engaged.

According to the slide fastener 10 of the embodiment, the second engaging part 25 is formed from the vicinity of the central line DL of of the tape members 12 in the front-rear direction over the end portion of the engaging portion 17 at a rear side, and the gaps S2 are created between the upper and lower ends of the first engaging parts 24 and the standing portions of the second engaging parts 25 of the adjacent fastener elements 15, so that even when the slide fastener 10 is bent projectingly frontwards, the second engaging parts 25 which do not contribute to the engagement when engaged in a linear pattern, become engaged with each other, increasing the engaged area of the engaging portion 26, thereby improving the flexibility of the slide fastener while intensifying the engagement between the left and right fastener element rows 14.

According to the slide fastener 10 of the embodiment, the upper and lower surfaces 22*a* and 22*b* of the engaging head portion 22 are defined by inclined surfaces which gradually decrease in width from the neck portion 23 to the outer end portions 22*c* of the engaging head portion 22 in the left-right direction, and the gaps S2 are created between the upper and lower ends of the first engaging parts 24 and the standing portions of the second engaging parts 25 of the adjacent fastener elements 15, so that even when the slide fastener 10 is bent in the left-right direction, adjacent engaging portions 17 do not interfere with each other, thereby improving the flexibility of the slide fastener 10.

According to the slide fastener 10 of the embodiment, both left and right side surfaces 16*c* and 16*c* of the design portion 16 of the fastener element 15 and both left and right side surfaces 21*c* and 22*c* of the engaging portion 17 of the fastener element 15 are defined by semi-circular inclined surfaces, so that the fastener element 15 is likely to enter the element guide passage 38 of the slider 30. Thus, it is easy to open and close the slide fastener 10 because the slider 30 can be manipulated with less force.

The present invention is not limited to the above-mentioned embodiments, but may be modified in a variety of forms within the scope of the technical spirit of the present invention.

Figure 14:
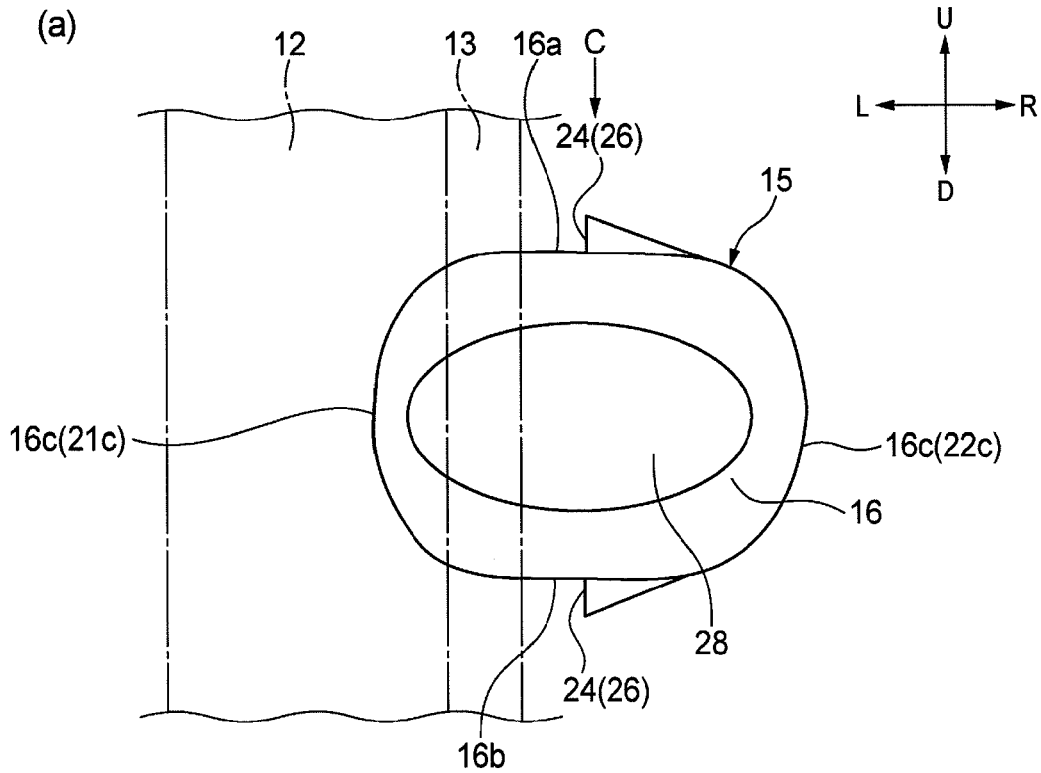
FIGS. 14(*a*) and 14(*b*) are views showing modified embodiments of the slide fastener according to the present invention, wherein FIG. 14(*a*) is a front surface view of the fastener element, and FIG. 14(*b*) is a view of the fastener element when viewed in a direction of the arrow C of FIG. 14(*a*).
Figure 14:
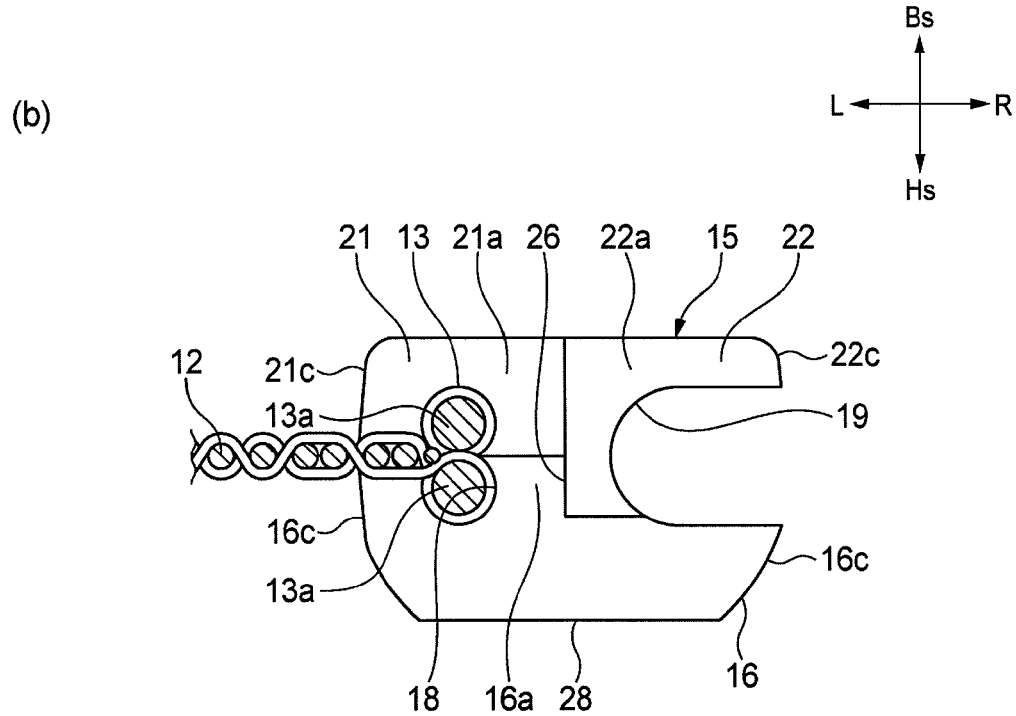

For example, in the above embodiments, in order to secure the flexibility of the slide fastener 10, it may suffice that a curved surface of the design portion 16 from the tape-contact surface to the front side top of the design portion 16 (an intersecting point between the central line HL in the left-right direction and the central line VL in the up-down direction in the design portion 16) is formed at least from the side of tape-contact surface, and as shown in a modified embodiment shown in FIG. 14, a planar portion 28 which is in parallel with the tape member 12 is formed on the design portion 16 of the fastener element 15. Thus, other designs that are different from that of the above embodiments can be applied to the fastener element 15.

Further, in the present embodiment, the length L1 of the first engaging part 24 in the up-down direction may be set to be equal to the length L2 of the gap S1 between the adjacent design portions 16 in the up-down direction when the left and right fastener element rows 14 are engaged with each other in a linear fashion. Thus, it is possible to enhance the engaging strength while sacrificing the flexibility to some extent.

DESCRIPTION OF REFERENCE NUMERALS

10 Slide fastener
12 Tape member
13 Tape-side edge
13*a* Core string
14 Fastener element row
15 Fastener element
16 Design portion
16*a* Upper end of design portion
16*b* Lower end of design portion
17 Engaging portion
19 Tape-receiving groove
21 Base portion
21*a* Upper surface of base portion
21*b* Lower surface of base portion
21*c* Outer end portion (side surface) of base portion in left-right direction
22 Engaging head portion
22*a* Upper surface of engaging head portion
22*b* Lower surface of engaging head portion
22*c* Outer end portion (side surface) of engaging head portion in left-right direction
23 Neck portion
24 First engaging part
25 Second engaging part
26 Engaging portion
30 Slider
31 Upper blade
32 Lower blade
33*a* Upper flange
33*b* Lower flange
34 Guide post
35 Pull-tab attaching portion
36 Shoulder mouth
37 Rear mouth
38 Element guide passage
39 Parallel portion
HL Central line of fastener element in left-right direction
VL Central line of fastener element in up-down direction
DL Central line of tape member in front-rear direction
S1 Gap
S2 Gap
S3 Gap
L1 Length of first engaging part in up-down direction
L2 Length of gap between design portions in up-down direction
L3 Length of design portion in up-down direction
L4 Dimension of gap between upper and lower flanges in up-down direction
L5 Dimension of core strings in front-rear direction
C1 Distance between fastener elements
C2 Distance between design portions
T Plate thickness of upper and lower flanges

The invention claimed is:

1. A slide fastener comprising:

a pair of tape members disposed in parallel in a left-right direction, a pair of fastener element rows attached to the tape members, and a slider into which the pair of fastener element rows are inserted, the slider engages and disengages the pair of fastener element rows, wherein each of the fastener element rows is composed of a plurality of fastener elements, wherein each of the fastener elements includes a design portion disposed at a front side of its respective tape member, and an engaging portion disposed at a rear side of its respective tape member so as to engage with an adjacent fastener element attached to a counterpart tape member, wherein the design portion is disposed distant from an adjacent design portion when engaged, wherein a tape-receiving groove for receiving the tape-side edge of the counterpart tape member when engaged is provided at a leading end portion of each of the fastener elements and between the design portion and the engaging portion, wherein the engaging portion includes a base portion attached to the tape member, an engaging head portion extending from the base portion towards the counterpart tape member and having the tape-receiving groove therein, and a neck portion provided between the base portion and the engaging head portion, wherein the engaging head portion has engaging parts protruding in an up-down direction, wherein the engaging parts of the engaging head portion include first engaging parts protruding from an upper end and a lower end of the design portion in the up-don direction, respectively, and second engaging parts continued from the first engaging parts respectively, and wherein a length of each of the first engaging parts in the up-down direction is set to be shorter than a length of a gap between the design portions adjacent to each other in the up-down direction when the pair of fastener element rows are engaged with each other in a linear fashion.

2. The slide fastener according to claim 1, wherein the first engaging parts are formed so as to extend toward a side of the design portion beyond a central line of the tape members in a front-rear direction thereof.

3. The slide fastener according to claim 1, wherein the first engaging parts are formed only inside relative to an end portion of the tape-receiving groove at a side of the design portion in a front-rear direction thereof.

4. The slide fastener according to claim 1, wherein the design portion has a hemispherical shape.

5. The slide fastener according to claim 1, wherein each of the second engaging parts is formed from a vicinity of a central line of the tape members in a front-rear direction over an end portion of the engaging portion at a rear side.

6. The slide fastener according to claim 1, wherein the design portion is formed in a curved shape which is longitudinally symmetric with respect to a central line of the design portion in the left-right direction and is laterally symmetric with respect to a central line of the design portion in the up-down direction.

7. The slide fastener according to claim 1, wherein both left and right sides of the design portion are defined by curved surfaces which are gradually curved in the up-down direction from a central line of the fastener elements in the left-right direction.

8. A slide fastener comprising:

a pair of tape members disposed in parallel in a left-right direction, a pair of listener element rows attached to the tape members, and a slider into which the pair of fastener element rows are inserted, the slider that engages and disengages the pair of fastener element rows, wherein each of the fastener element rows is composed of a plurality of fastener elements, wherein each of the fastener elements includes a design portion disposed at a front side of its respective tape member, and an engaging portion disposed at a rear side of its respective tape member so as to engage with an adjacent fastener element attached to a counterpart tape member, wherein design portion is disposed distant from an adjacent design portion when engaged, wherein a tape-receiving groove for receiving the tape-side edge of the counterpart tape member when engaged is provided at a leading end portion of each of the fastener elements and between the design portion and the engaging portion, wherein the engaging portion includes a base portion attached to the tape member, an engaging head portion extending from the base portion towards the counterpart tape member and having the tape-receiving groove therein, and a neck portion provided between the base portion and the engaging head portion, wherein the engaging head portion has engaging parts protruding in an up-down direction, wherein the engaging parts include first engaging parts protruding from an upper end and a lower ends of the design portion in the up-down direction, respectively, and second engaging parts continued from the first engaging parts respectively, and wherein the first engaging parts are formed so as to extend toward a side of the design portion beyond a central line of the tape members in a front-rear direction thereof.

9. The slide fastener according to claim 8, wherein the first engaging parts are formed only inside relative to an end portion of the tape-receiving groove at a side of the design portion in the front-rear direction thereof.

10. The slide fastener according to claim 8, wherein the design portion has a hemispherical shape.

11. The slide fastener according to claim 8, wherein each of the second engaging parts is formed from a vicinity of the central line of the tape members in the front-rear direction over an end portion of the engaging portion at a rear side.

12. The slide fastener according to claim 8, wherein the design portion is formed in a curved shape which is longitudinally symmetric with respect to a central line of the design portion in the left-right direction and is laterally symmetric with respect to a central line of the design portion in the up-down direction.

13. The slide fastener according to claim 8, wherein both left and right sides of the design portion are defined by curved surfaces which are gradually curved in the up-down direction from a central line of the fastener elements in the left-right direction.

* * * * *

UNITED STATES PATENT AND TRADEMARK OFFICE

CERTIFICATE OF CORRECTION

PATENT NO. : 8,832,909 B2
APPLICATION NO. : 13/498962
DATED : September 16, 2014
INVENTOR(S) : Go Takani It is certified that error appears in the above-identified patent and that said Letters Patent is hereby corrected as shown below:

In the Specification

In column 3, line 20, delete “the a” and insert -- the --, therefor.

In column 3, line 30, below “gap.” insert -- According to the slide fastener of the present invention, the fastener elements are independently disposed in the up-down direction of the tape member when engaged. The fastener element includes a design portion disposed at a front side of the tape member, and an engaging portion disposed at a rear side of the tape member so as to engage with adjacent fastener element. The design portion is disposed distant from the adjacent design portion and has a hemispherical shape with a curved shape, thereby securing the flexibility of the slide fastener when engaged and improving the designability of the slide fastener. --.

In column 7, line 61, delete “is are” and insert -- is --, therefor.

In column 10, line 19, delete “of of” and insert -- of --, therefor.

In the Claims

In column 12, line 37, in claim 1, delete “up-don” and insert -- up-down --, therefor.

In column 13, line 7, in claim 8, delete “listener” and insert -- fastener --, therefor.

In column 13, line 20, in claim 8, after “wherein” insert -- the --.

In column 14, line 4, in claim 8, delete “ends” and insert -- end --, therefor.

Signed and Sealed this
Thirteenth Day of January, 2015

Michelle K. Lee

Michelle K. Lee
*Deputy Director of the United States Patent and Trademark Office*